US011529533B1

(12) United States Patent
Kopf

(10) Patent No.: US 11,529,533 B1
(45) Date of Patent: Dec. 20, 2022

(54) PERSONAL SPACE PROTECTIVE ENCLOSURE

(71) Applicant: Drew Geoffrey Kopf, New York, NY (US)

(72) Inventor: Drew Geoffrey Kopf, New York, NY (US)

( * ) Notice: Subject to any disclaimer, the term of this patent is extended or adjusted under 35 U.S.C. 154(b) by 0 days.

(21) Appl. No.: 17/880,289

(22) Filed: Aug. 3, 2022

Related U.S. Application Data

(60) Provisional application No. 63/345,987, filed on May 26, 2022.

(51) Int. Cl.
*A62B 31/00* (2006.01)
*A62B 18/02* (2006.01)
*A62B 23/02* (2006.01)

(52) U.S. Cl.
CPC ..... *A62B 31/00* (2013.01); *A62B 18/02* (2013.01); *A62B 23/02* (2013.01)

(58) Field of Classification Search
CPC ..... A62B 31/00; A62B 13/00; A62B 18/02; A62B 18/025; A62B 18/003; A62B 18/006; A62B 23/04; A62B 23/02; A61G 10/00; A61G 10/02; A61G 10/005; A61G 10/023; A61G 10/04; E06B 3/70; E06B 3/80;
(Continued)

(56) References Cited

U.S. PATENT DOCUMENTS 1,649,943 A 11/1927 Boeck
3,331,425 A 7/1967 Groves et al.
3,899,168 A 8/1975 Besherse
(Continued)

FOREIGN PATENT DOCUMENTS

EP 2537600 A1 * 12/2012 ..... B08B 15/026
GB 2415887 A * 1/2006 ..... E06B 3/80
(Continued)

OTHER PUBLICATIONS

Alan Taylor; "Socializing in a Pandemic, Protected by Plastic," retrieved online <https://www.theatlantic.com/photo/2020/05/photos-socializing-pandemic-protected-by-plastic/612088/>: 22 pages (2020).
(Continued)

*Primary Examiner* — Joseph D. Boecker
*Assistant Examiner* — Brian T Khong
(74) *Attorney, Agent, or Firm* — Foley Hoag LLP; N. Scott Pierce

(57) ABSTRACT

A personal space protective enclosure defines an enclosed space that protects individuals within the enclosed space from infection by airborne pathogens. A plurality of vertically-hanging strips hang on hooks on a strip-mounting frame that is supported by a vertical support stanchion, or a plurality thereof. The hooks each have a rectangular cross-section defining and a straight upper surface when viewed in one direction and a curvilinear cross-section when viewed in another direction. The vertically-hanging strips each define an opening that has an upper straight edge that is contiguous with the straight upper surface of the hooks when hanging in resting position, and which return to the resting position after being disturbed from the resting position, such as by an individual reaching between the vertically-hanging strips.

16 Claims, 14 Drawing Sheets

(58) Field of Classification Search
CPC ..... F24F 3/16; F24F 8/10; A47K 3/38; A61L 9/032; A47H 13/04
See application file for complete search history.

(56) References Cited

U.S. PATENT DOCUMENTS

| | | | | |
|---|---|---|---|---|
| 4,095,642 | A | 6/1978 | McKinnon et al. | |
| 4,355,678 | A | 10/1982 | Romano | |
| 4,367,781 | A | 1/1983 | Vallieres, Jr. et al. | |
| 4,384,606 | A | 5/1983 | Johnston et al. | |
| 4,452,240 | A | 6/1984 | Moretti | |
| 5,125,402 | A | 6/1992 | Greenough | |
| 5,429,404 | A | 7/1995 | King, Sr. | |
| 6,162,118 | A | 12/2000 | Arts et al. | |
| 7,011,132 | B2 | 3/2006 | Robbins, III | |
| 7,275,535 | B1 | 10/2007 | Brockman | |
| 7,380,296 | B2 | 6/2008 | Ellen et al. | |
| 8,464,366 | B2 | 6/2013 | Carron | |
| 2004/0074212 | A1* | 4/2004 | Yachi | B01D 46/0016 55/385.2 |
| 2008/0012258 | A1 | 1/2008 | Townsend | |
| 2008/0216968 | A1* | 9/2008 | Falato | E06B 3/80 160/200 |
| 2010/0000119 | A1 | 1/2010 | Ueno et al. | |
| 2015/0096603 | A1 | 4/2015 | Nadel | |
| 2019/0330874 | A1 | 10/2019 | Pescovitz | |
| 2021/0307984 | A1* | 10/2021 | Akers | A61G 10/005 |
| 2022/0040354 | A1* | 2/2022 | Magee | A61L 9/22 |
| 2022/0062081 | A1* | 3/2022 | Griffith | A61G 10/023 |

FOREIGN PATENT DOCUMENTS

| | | | | |
|---|---|---|---|---|
| WO | WO-2021240559 | A1 * | 12/2021 | A61B 5/01 |
| WO | WO-2021257850 | A1 * | 12/2021 | A61G 10/02 |

OTHER PUBLICATIONS

Cleanroom Curtains and Strip Shields; retrieved online <https://www.terrauniversal.com/cleanroom-curtains-and-strip-shields.html>: 6 pages (2022).

Lopez., "A restaurant is testing plastic 'shield pods' to keep diners safe during the coronavirus pandemic," retrieved online <https:/www.insider.com/a-restaurant-is-testing-plastic-shield-pods-keep-diners-safe-2020-5.>: 7 pages (2020).

Mary Meisenzahl., "A designer created a solar-powered inflatable 'Bubble Shield' that filters the air around the wearer to protect from the coronavirus," retrieved online <https://www.businessinsider.com/plastic-bubble-shield-design-to-stop-coronavirus-spread-2020-4>: 13 pages (2020).

ShieldPod—Under The Weather; retrieved online <https://utwpods.com/collections/healthcare>: 3 pages (2022).

ShieldPod—Under The Weather; retrieved online <https:https://utwpods.com/products/shieldpod>: 7 pages (2022).

ShieldPod WalkingPod Pro Testing; retrieved online <https://ww1.prweb.com/prfiles/2020/05/05/17100931/WalkingPod-Pro-Testing3.jpg>: 1 page (2020).

* cited by examiner

PERSONAL SPACE PROTECTIVE ENCLOSURE

RELATED APPLICATIONS

This application claims the benefit of priority to U.S. Provisional Patent Application Ser. No. 63/345,987 filed May 26, 2022, the contents of which are incorporated herein in their entirety.

BACKGROUND OF THE INVENTION

Infectious diseases that are transmissible through aerosolized droplets cause large-scale global pandemic events, such as Covid-19 or the SARS outbreak of 2003. Moreover, these diseases cause dramatic disruptions to society and the global economy, resulting in still further costs to human health and well-being. Experts estimate that most if not all of these deaths are preventable. For example, the wearing of correctly fitting facemasks or coverings has been an effective means of reducing the transmission of the SARS-CoV-2 virus from person to person.

Preventative measures, such as face masks, are often either ineffective or impractical when conducting certain daily activities, such as eating or drinking in a public venue. Further, face masks are limited to protection against inhalation of airborne pathogens. Conversely, other, more comprehensive forms of protection against transmissible disease, such as encapsulation in "space" suits, and clean rooms, typically prevent selective interaction outside of the protected area, and are bulky and often immobile.

The use of face masks often precludes seeing one another's faces. The availability of a device that would allow people to see each other's faces when interacting with one another while still being able to maintain a high level of protection against being exposed to droplet infection would also be greatly appreciated by individuals and organizations.

Therefore, a need exists for a protective enclosure that overcomes or minimizes the above-mentioned deficiencies.

SUMMARY OF THE INVENTION

The invention generally is directed to a personal space protective enclosure that protects individuals within the enclosure from infection by airborne pathogens.

The personal space protective enclosure of the invention includes a strip-mounting frame and at least one vertical support stanchion supporting the strip-mounting frame. A plurality of hooks at the strip-mounting frame, each of which has a rectangular cross-section having a straight upper surface when viewed in one direction and a curvilinear cross-section when viewed in another direction. A plurality of vertically-hanging strips, each defining a center of gravity and an opening at one end above the center of gravity, hang from the hooks, and fits each hook exactly. Each vertically-hanging strip is separately hung on a single hook of the plurality of hooks. In embodiment, the opening of each vertically-hanging strip has a straight upper edge that is contiguous with the straight upper surface of the rectangular cross-section of the hook when the vertically-hanging strip is in a resting position, wherein the vertically-hanging strips are distributed along the strip-mounting frame in partially overlapping relation to each other, whereby each vertically-hanging strip will resume the resting position by force of gravity after having been disturbed, thereby reestablishing the previously created and defined enclosed space.

This invention has many advantages. For example, the strip-mounting frame of the invention suspends vertically-hanging strips to create an enclosed space that essentially prevents passage of airborne pathogens that would otherwise be available to infect individuals within the enclosed space. In addition, the vertically-hanging strips define openings that define upper straight edges and are hung from hooks defining rectangular cross-sections on the strip-mounting frame, whereby upper straight edges of the openings of the vertically-hanging strips are contiguous with the upper straight edges of the rectangular cross sections of the hooks in a resting position of the vertically-hanging strips. The center of gravity of the vertically-hanging strips is below the openings of the vertically-hanging strips. As a result, the vertically-hanging strips easily return to the resting position by force of gravity after having been disturbed, thereby permitting access by an individual or individuals within the enclosed space to the surrounding space, such as by individuals reaching out through the vertically-hanging strips to grasp objects not within the enclosed space. The enclosed space is also accessible from outside the enclosed space to individuals within, such as by wait staff serving patrons in the enclosed space in a restaurant. The stanchion is a stick or a pole or a rod or a column that supports the entire unit. Velcro™ fastening closures or strips can be used to bind the stanchion to the leg and to the upper handle or cross bar of a shopping cart as an example of how the stanchion could get affixed to unit. That would allow a user to shop in a store and be within the protected area of the invention throughout their shopping experience. The stanchion can be secured to support units that have wheels, such as the shopping cart example. The stanchions can positioned around a dining room table in a restaurant was to provide them with empty plastic jars or can-like units that could be filled with water so as to give then the weight that would be needed to support and hold that stanchions while they were being used. These support units would have a hole into which a stanchion could be placed to keep it during use. Retractable wheels to the stanchion support units, when present, would be useful where restaurant staff would want to set up, for example, for a family of six instead of four, in which case, the stanchions would have to be repositioned and since they were pretty heavy it would be an undue strain on the staff, and if the stanchion bases were able to be rolled it would make life easier and frankly safer for the staff.

BRIEF DESCRIPTION OF THE DRAWINGS

The foregoing will be apparent from the following more particular description of example embodiments, as illustrated in the accompanying drawings in which like reference characters refer to the same parts throughout the different views. The drawings are not necessarily to scale, emphasis instead being placed upon illustrating embodiments. The same number present in different figures represents the same item.

DETAILED DESCRIPTION OF THE INVENTION

The invention generally is directed to a personal space protective enclosure that reduces exposure of individuals and/or small groups to airborne pathogens without the need for wearing masks or of maintaining social distancing or even of being vaccinated.

Figure 1:
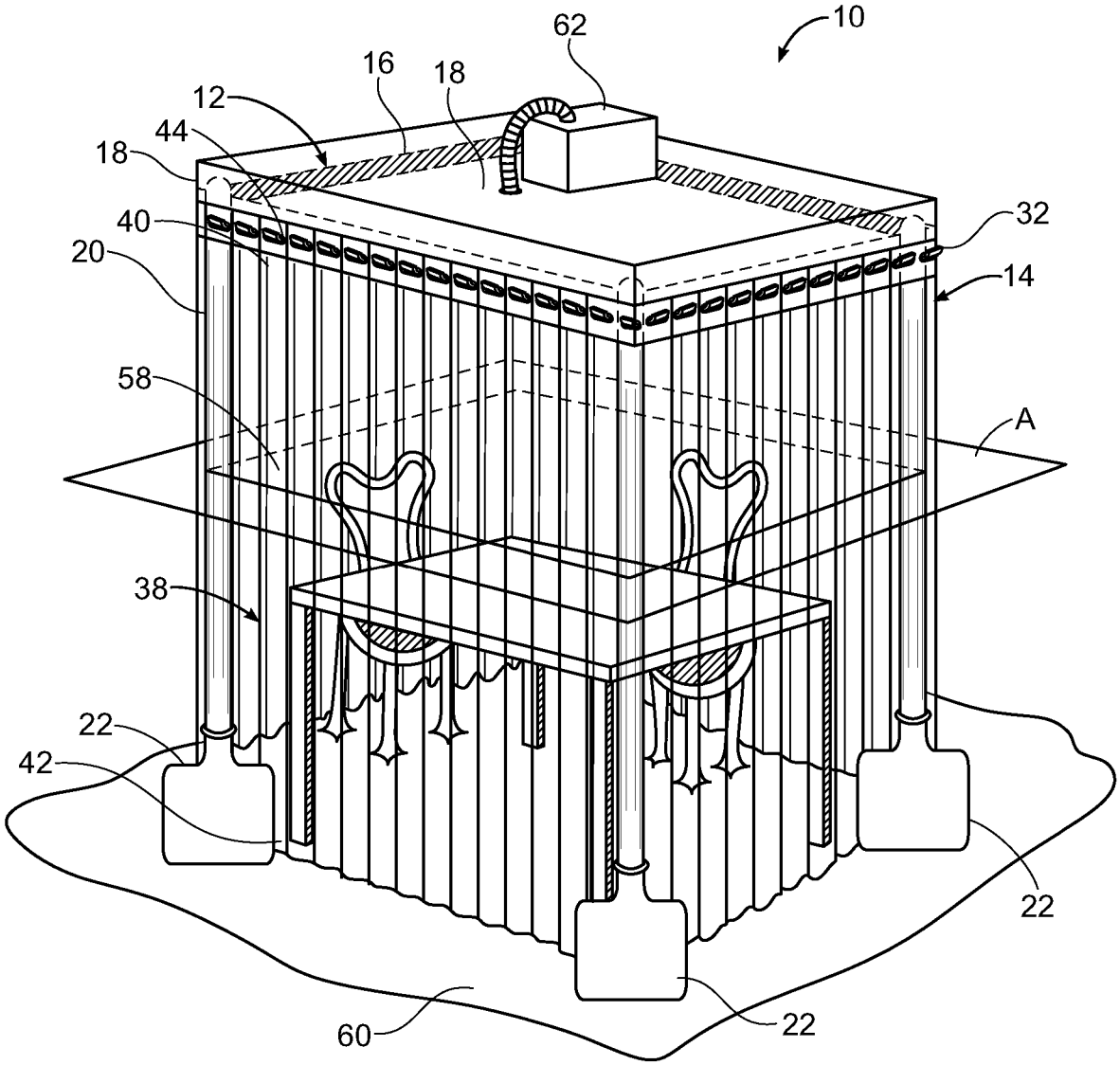
FIG. 1 is a perspective view of one embodiment of the personal space protective enclosure of the invention.

One embodiment of a personal space protective enclosure 10 of the invention is shown in FIG. 1. As shown therein, strip-mounting frame 12 is supported by support stanchion 14. Strip mounting frame 12 includes frame components, namely rods 16, that are horizontally mounted between legs 20 of support stanchion 14 and cap 18. It is to be understood, however, that, in alternative embodiments, strip-mounting frame 12 need not necessarily include distinct components, and rod 16 need not necessarily be mounted horizontally between legs 20 of support stanchion 14. For example, in one embodiment (not shown), strip-mounting frame 12 can be, for example, a single piece, and can be set at a positive angle to a level surface. Further, support stanchion 14 need not be formed of a plurality of legs 20, but can, for example, be a single support (not shown). Also, support stanchion 14 need not be vertical, as shown in FIG. 1, but can assume a variety of shapes, such as a tripod to which strip mounting frame 12 is fixed at its peak.

Figure 2A:
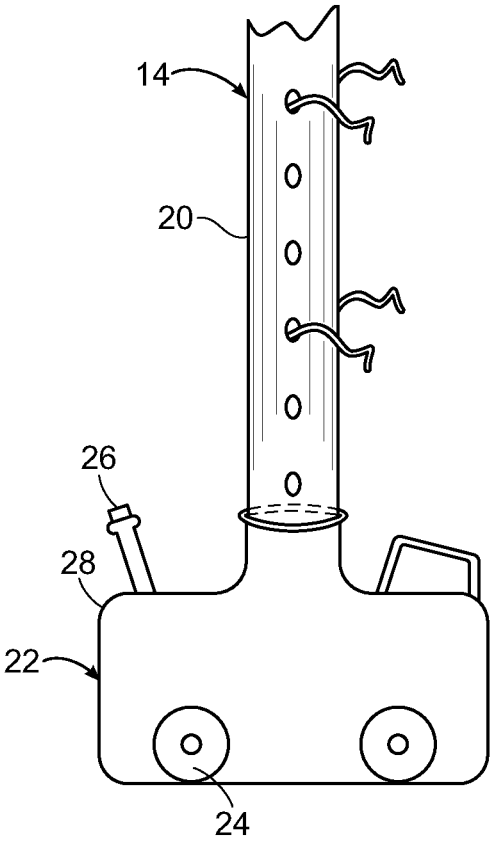
FIG. 2A is a detail of FIG. 1, showing a wheel assembly at the lower portion of legs of a support stanchion component of the personal space protective enclosure of the invention, wherein the wheels are in a retracted position.
Figure 2B:
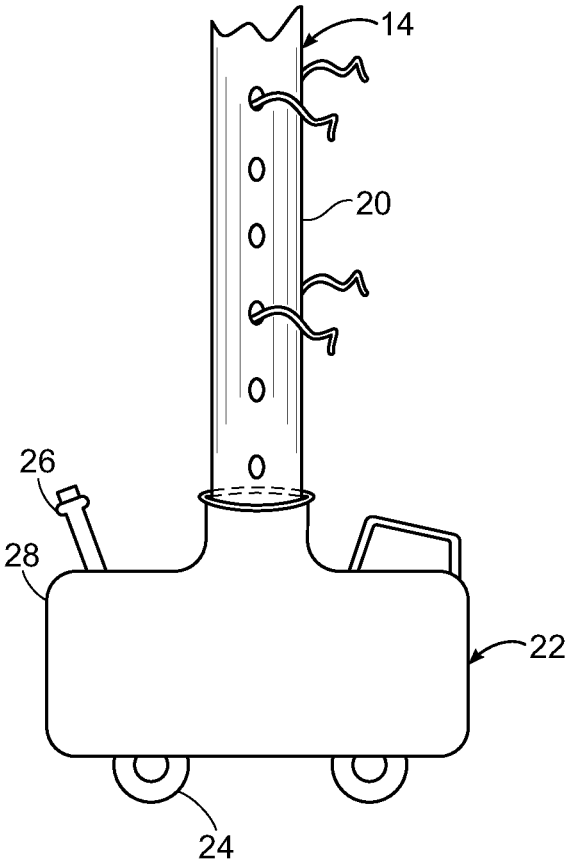
FIG. 2B is a representation of the wheel assembly shown in FIG. 2A wherein the wheels are in an exposed and functional position, whereby the personal space protective enclosure is repositionable.
Figure 3:
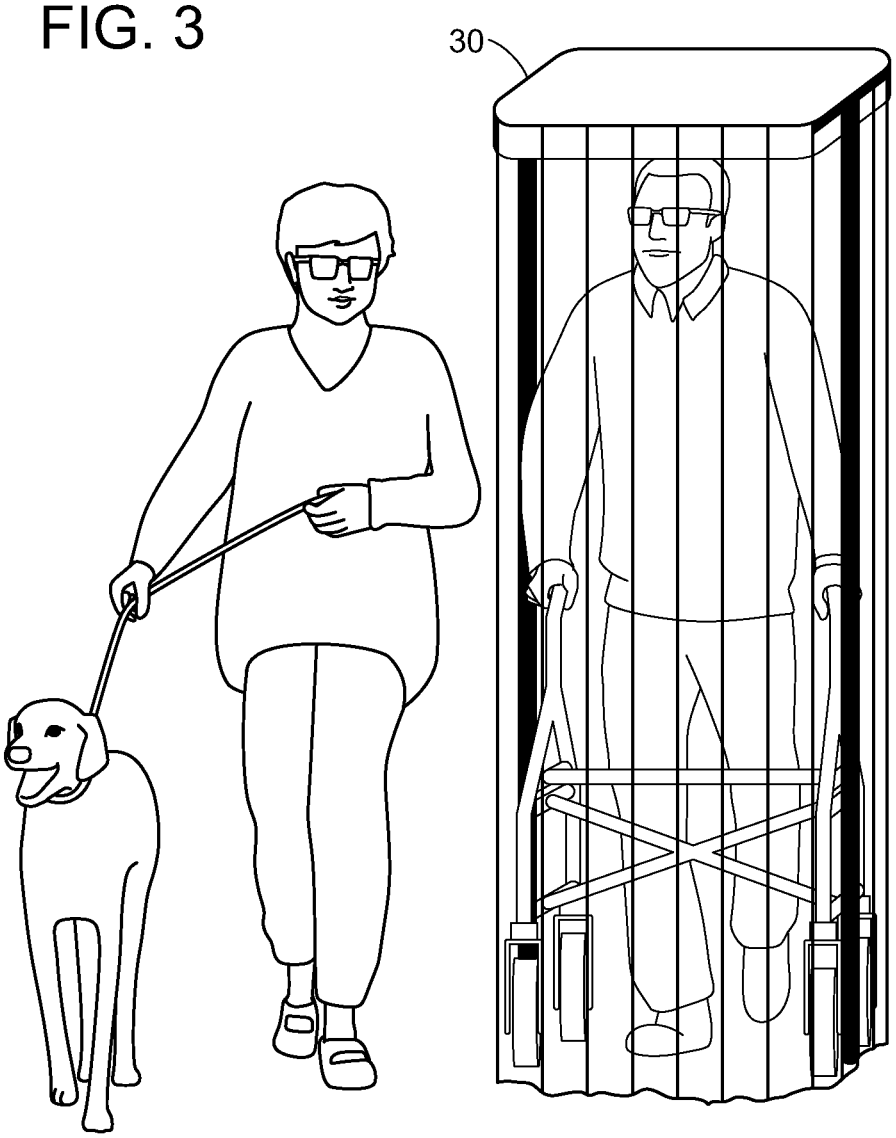
FIG. 3 is a perspective view of another embodiment of a personal protective space enclosure of the invention, wherein the personal protective space enclosure is mounted to or includes a walker that allows the enclosure to be mobile.

In certain embodiments, the support stanchion can be attached to or be a piece of furniture, such as a desk or a table. In another embodiment, the support stanchion is mounted on at one least wheel or set of wheels, such those of wheel assemblies 22 shown in FIG. 1. As can be seen in FIGS. 2A and 2B, wheels 24 of wheel assemblies 22 can be retractable by use of, for example, foot pedal 26 at housing 28 of wheel assembly 22. In some embodiments, the support stanchion is attached to or is a component of a mobile cart, such as a shopping cart or walker 30, such as is shown in FIG. 3. The stanchion is a stick or a pole or a rod or a column that supports the entire unit. Velcro™ fastening closures or strips can be used to bind the stanchion to the leg and to the upper handle or cross bar of a shopping cart as an example of how the stanchion could get affixed to unit. That would allow a user to shop in a store and be within the protected area of the invention throughout their shopping experience. The stanchion can be secured to support units that have wheels, such as the shopping cart example. The stanchions can positioned around a dining room table in a restaurant was to provide them with empty plastic jars or can-like units that could be filled with water so as to give then the weight that would be needed to support and hold that stanchions while they were being used. These support units would have a hole into which a stanchion could be placed to keep it during use. Retractable wheels to the stanchion support units, when present, would be useful where restaurant staff would want to set up, for example, for a family of six instead of four, in which case, the stanchions would have to be repositioned and since they were pretty heavy it would be an undue strain on the staff, and if the stanchion bases were able to be rolled it would make life easier and frankly safer for the staff.

Figure 4A:
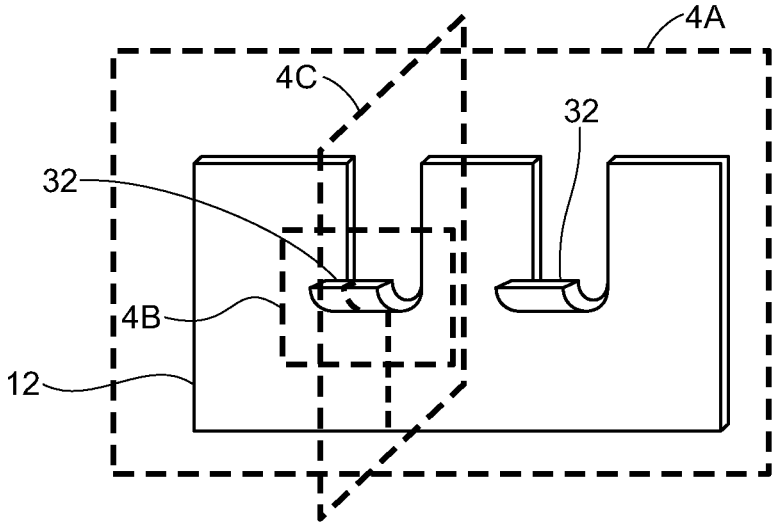
FIG. 4A is a detail of hooks of the personal protective space enclosure of FIG. 1.
Figure 4B:
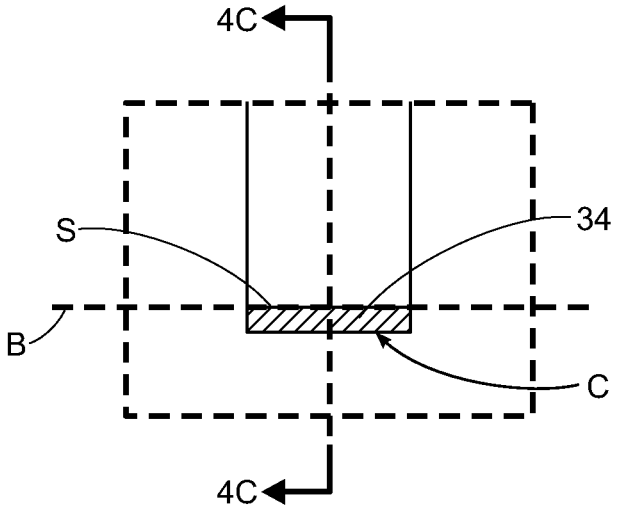
FIG. 4B is a view of a hook of the hooks shown in FIG. 4A, in plane 4B of FIG. 4A.
Figure 4C:
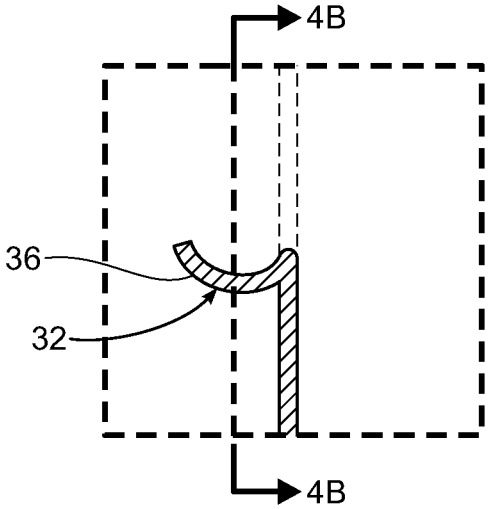
FIG. 4C is a view of the hook of FIG. 4B, in plane 4C of FIG. 4A.

As can be seen in FIG. 1, hooks 32 are mounted on, or are integral to, strip-mounting frame 12. As can be seen in FIGS. 4A through 4C, hooks 32 have rectangular cross-section 34 when viewed in one direction, as shown in FIG. 4B, taken along line 4B-4B of FIGS. 4A and 4C, which is parallel to plane 4A defined by the side of strip-mounting frame 12 shown in FIG. 4A. Cross section 34 of hook 32 has circumference C and an upper surface S that defines line B. Each hook also has a curvilinear cross-section 36 when viewed in another direction, as shown in FIG. 4C, taken along line 4C-4C of FIGS. 4A and 4B, which is orthogonal to plane 4A.

Figure 5B:
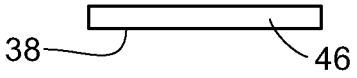
FIG. 5B is a cross section in plane 5B of the vertically-hanging strip of FIG. 5A
Figure 5A:
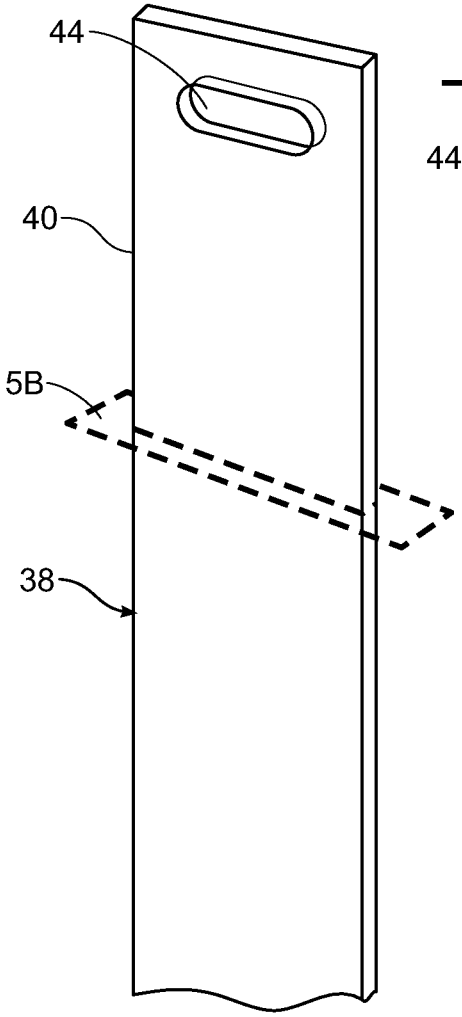
FIG. 5A is a perspective view of and upper portion of one vertically-hanging strip shown in FIG. 1.
Figure 5C:
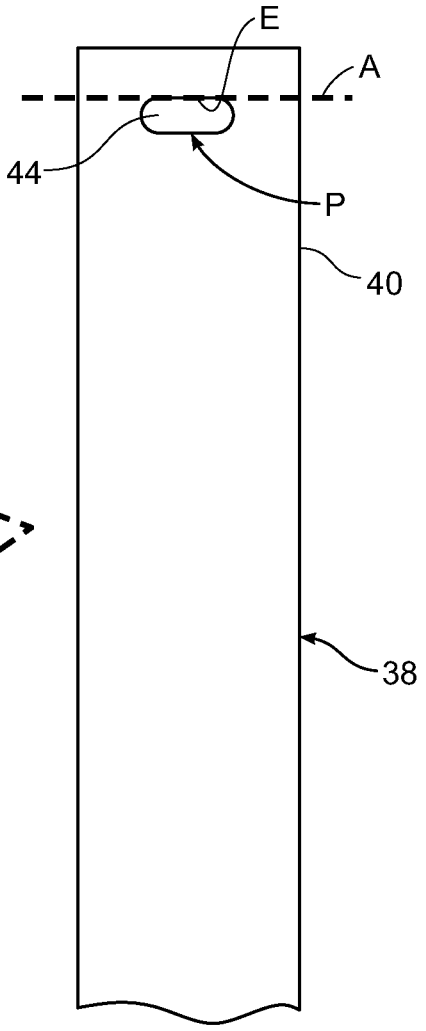
FIG. 5C is a plan view of the vertically-hanging strip of FIG. 5A.
Figure 5D:
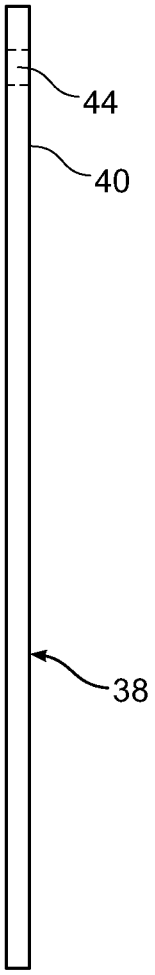
FIG. 5D is a side view of the vertically-hanging strip of FIG. 5A

Referring back to FIG. 1, plurality of vertically-hanging strips 38 each have top portion 40 and bottom portion 42, and define openings 44 at top portions 40 of vertically-hanging strips 38. Each vertically-hanging strip 38 hangs from a separate hook 32. Each vertically-hanging strip 38 defines opening 44 at top portion 40, as shown in FIG. 5A, and has a rectangular cross section 46, as shown in FIG. 5B. Each opening 44 defines a straight upper edge E that defines line A, Each opening 44 also defines perimeter P, shown at FIG. 5C. Opening 44 extends through vertically-hanging strip 38, as shown in FIG. 5D. In one embodiment, the perimeter P of each opening 44 fits exactly the circumference C of each hook. Further, shaped of each opening 44 need not have the shape shown in FIGS. 6A-6C.

Figure 6A:
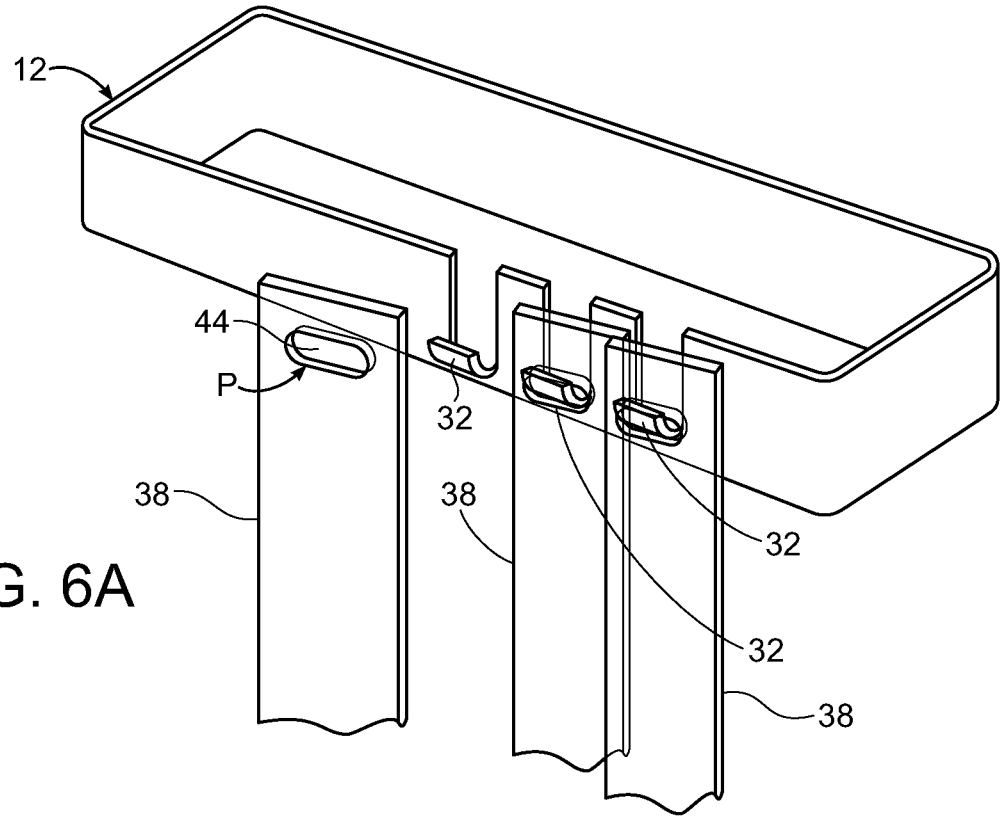
FIG. 6A is a perspective view of the strip-mounting frame of FIG. 1, with a portion of the hooks of the strip-mounting frame showing strips hanging from the hooks.
Figure 6B:
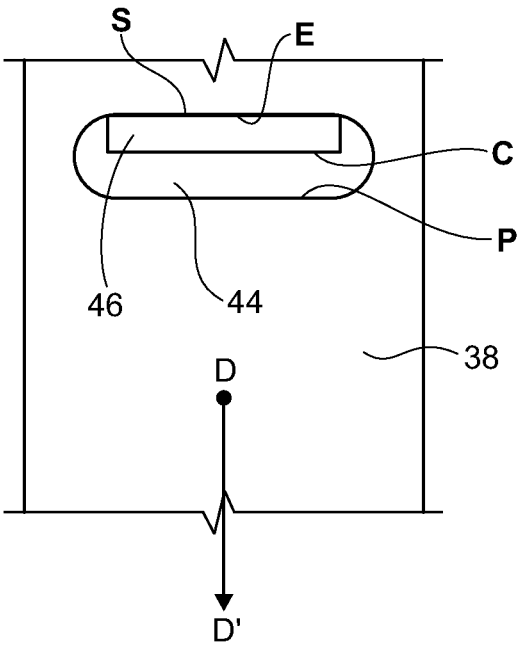
FIG. 6B is a plan view of an upper portion of a vertically-hanging strip hanging by an opening from a hook of FIG. 6A, wherein an upper surface E of the opening of the vertically-hanging strip is in a resting position that is contiguous with an upper surface S of the cross section of the hook.
Figure 6C:
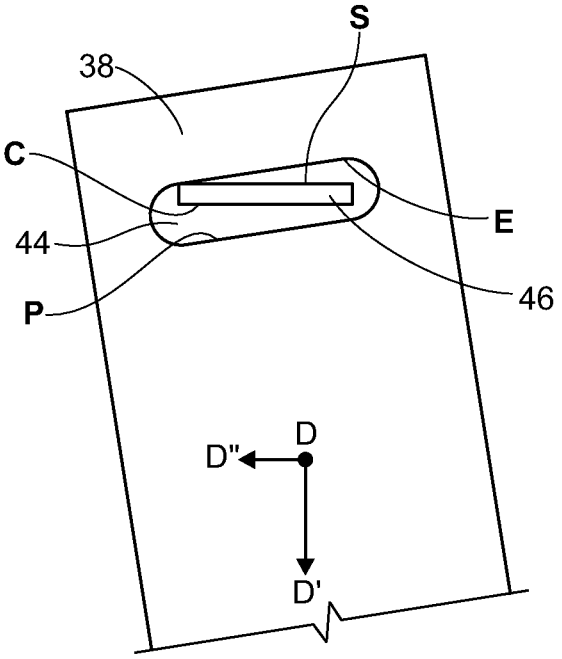
FIG. 6C is a view of FIG. 6B wherein the vertically-hanging strip has been pushed to one side, thereby causing the upper surface E of the surface of the vertically-hanging strip to be temporarily displaced from the resting position that is contiguous with the upper surface S of the cross-section of the hook.
Figure 6D:
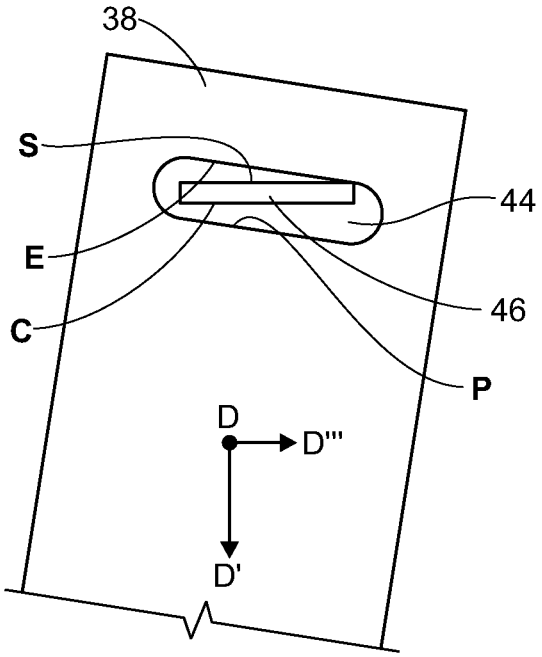
FIG. 6D is a view of FIG. 6C wherein the vertically-hanging strip has been pushed to an opposite side, thereby causing the upper surface E of the surface of the vertically-hanging strip to be temporarily displaced from the resting position that is contiguous with the upper surface S of the cross-section of the hook in an opposite direction from the displacement shown in FIG. 6C.

In one alternative embodiment, shown in FIG. 6A, the perimeter P of each opening 44 is larger than circumference C of each hook 32 from which each vertically-hanging strip 38 hangs. Each vertically-hanging strip 38 hangs vertically from each hook 32 when straight edge E of opening 44 is contiguous with straight upper surface S of each hook 32, as shown in FIG. 6B. Center of gravity D is below top portion 40. As a consequence of the fact that, in a resting position of vertically-hanging strips 38 shown in FIG. 6B, straight edge E of opening 44 is contiguous with straight upper surface S of each hook 32, that perimeter P of each vertically-hanging strip 38 is larger than circumference C of each hook. Center of gravity D of each vertically-hanging strip 38 is below opening 44 of each vertically-hanging strip 38 and is subject to the force of gravity D'. If vertically-hanging strips 38 are disturbed from their resting position, such as by an individual reaching between vertically-hanging strips 38 causing the center of gravity D to move to one side or the other, as shown in FIGS. 6C and 6D, then the force of gravity in direction D' on each vertically-hanging strip 38 will cause it to move in direction D" or D'", shown in FIGS. 6C and 6D, respectively, so that each vertically-hanging strip 38 will resume the resting position shown in FIG. 6B. As a result, vertically-hanging strips 38 are easily moved aside at points below hooks 32 to accommodate passage between them, and yet will quickly come to rest and resume a vertical orientation once any interference, such as passage between vertically-hanging strips 38 by an individual or object, is removed. The strips work as they do because of their flexibility in the up and down direction and their relative stiffness in the other direction. So, they are easily parted to reach through them but they fall back into place because they are also resistant to being dislodged.

Figure 7A:
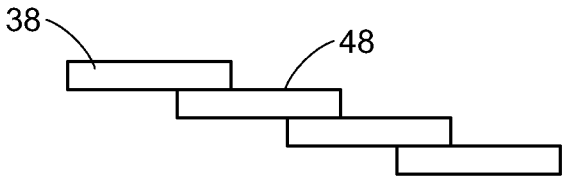
FIG. 7A is a cross section view of a portion of the vertically-hanging strips of the personal space protective enclosure of FIG. 1, showing overlap of the vertically-hanging strips.
Figure 7B:
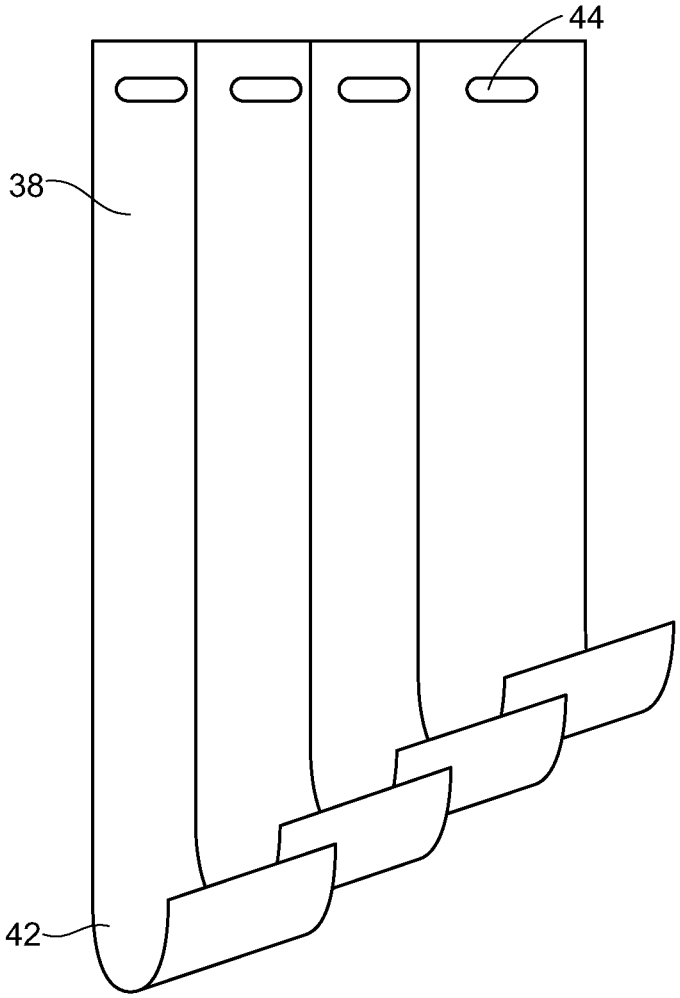
FIG. 7B is a perspective view of FIG. 7B showing that the lower portion of vertically-hanging strips of the personal space protective enclosure of FIG. 1 are free, and not fixed to each other or to any other portion of the personal space protective enclosure. The lower portion of the FIG. 7B is curled upward to demonstrate the flexibility of the strips being used and that they are not inflexible as could be assumed were we not to emphasize that the strips have a certain flexibility. Flexibility is in one direction; i.e. up and down. They are not so flexible left to right, which makes them just right for the job we need them to do; i.e. to fall back into place after they have been moved by someone reaching through them for some reason.

When hung from hooks 32, each vertically-hanging strip 38 overlaps, and is overlapped by, other vertically-hanging strips 38, as shown in FIGS. 1 and 6A. As shown in FIGS. 7A and 7B, vertically-hanging strips 38 define outwardly facing surfaces 48 that overlap, as can be seen most clearly in FIG. 7A, which is a cross section of overlapping vertically-hanging strips 38. Each of vertically-hanging strips 38 is tucked under an adjoining vertically-hanging strip 38 of the plurality of vertically-hanging strips 38. In one embodiment, not shown, the partially overlapping relation of the vertically-hanging strips 38 is at least one-half of the outwardly facing surface 48 of each of vertically-hanging strips 38. Bottom portion 42 of each vertically-hanging strip 38 is loose, as shown in FIG. 7B.

Figure 8A:
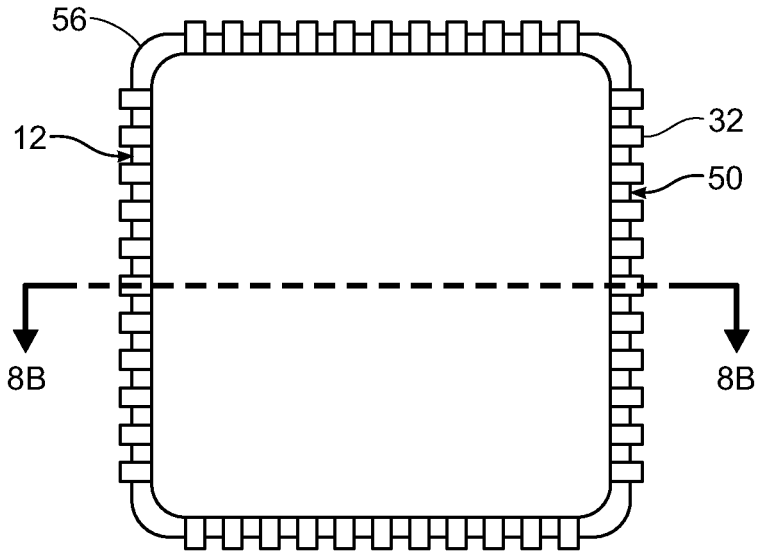
FIG. 8A is a plan view of the strip-mounting frame of FIG. 1.
Figure 8B:
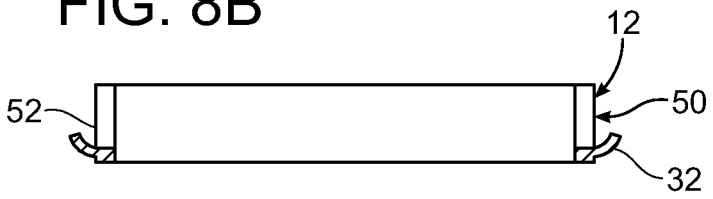
FIG. 8B is a cross section view of the strip-mounting frame of FIG. 8A taken along line 8A-8A.
Figure 8C:
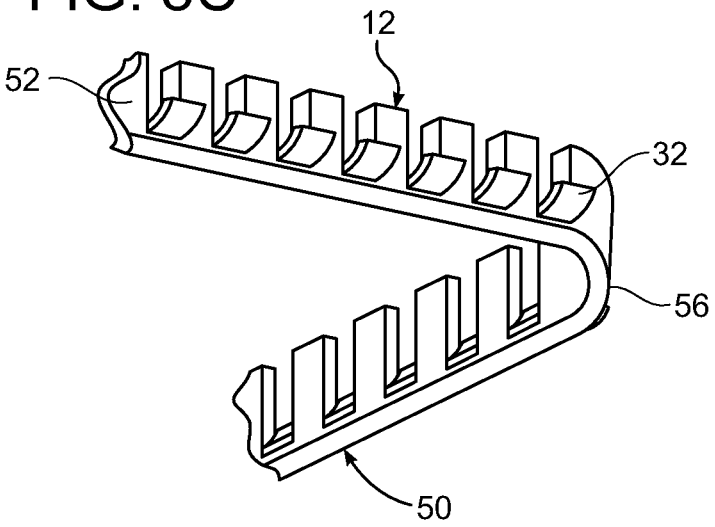
FIG. 8C is a detail view in perspective view of a corner of the strip-mounting frame of FIGS. 8A and 8B, showing that the corner is rounded.

One embodiment of strip-mounting frame 12 of FIG. 1 is shown in FIGS. 8A through 8C. FIG. 8A is a plan view of strip-mounting frame 12. FIG. 8B is a cross section of strip-mounting frame 12 shown in FIG. 8A, taken along line 8B-8B of FIG. 8A. As shown in FIG. 8B, strip-mounting frame 12 includes circumferential wall 50 that defines outer surface 52. Strip-mounting frame 12 includes rounded corners 56, as shown in FIGS. 8A and 8C.

Figure 9:
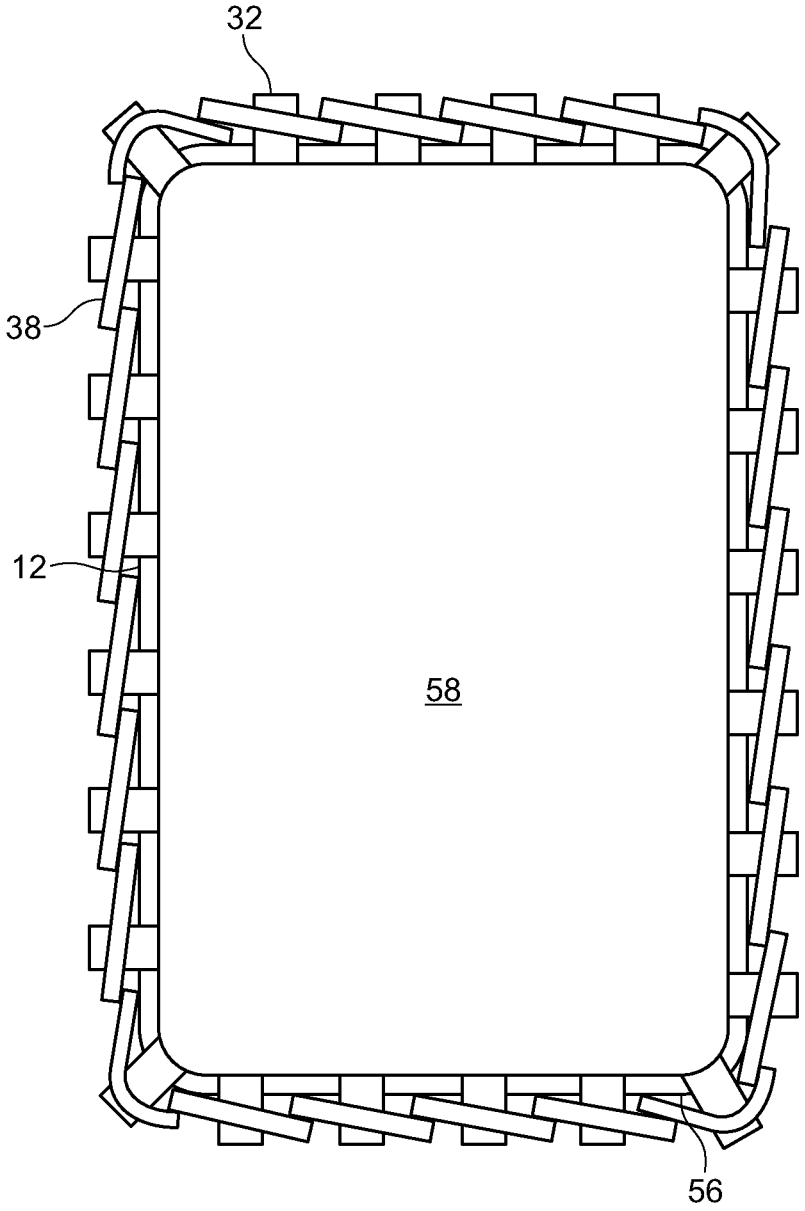
FIG. 9 is a plan view of the strip-mounting frame of FIGS. 8A through 8C, showing vertically-hanging strips mounted on hooks about an entire circumference of the strip-mounting frame, including molded corner strips.

A plan view of strip-mounting frame 12 showing mounting of vertically-hanging strips 38 from hooks 32 can be seen in FIG. 9. As can also be seen in FIG. 9, the plurality of vertically-hanging strips 38 is distributed around the entirety of strip mounting frame 12, whereby a last vertically-hanging strip 38 is tucked under an original vertically-hanging strip 38 of the plurality of vertically-hanging strips 38, as can also be seen in FIGS. 6A and 7A. Vertically-hanging strips 38 at corners 56 of strip-mounting frame 12 can be fabricated so that they approximately conform to corners 56, such the curvature of corners 57 of strip-mounting frame 12. When vertically-hanging strips 38 hang from all hooks 32, vertically-hanging strips 38 define an enclosed space 58, in horizontal plane A traversing personal space protective enclosure 10, as shown FIG. 1.

Suitable materials of construction of the personal space protective enclosure of the invention include materials known to those skilled in the art. For example, materials of construction of the vertically-hanging strip-mounting frame and the support stanchion include steel, aluminum, and suitable plastics.

In one embodiment, at least portions of vertically-hanging strips 38 are transparent. Vertically-hanging strips 38 are formed of a suitable material known to those skilled in the art, such as polyvinylchloride. In one embodiment, vertically-hanging strips are hermetic. Optionally, vertically-hanging strips 38 include at least one of a bactericide and a virucide.

Generally, vertically-hanging strips 38 have a length that is sufficient to extend from hooks to a supporting surface, such as floor 60 (which is not part of the invention) that is supporting support stanchion 14, as shown in FIG. 1. In other embodiments, however, such as where the support stanchion is, for example, a shopping cart or platform, such as a table (not shown), vertically-hanging strips 38 can be shorter in length than a distance of strip-mounting frame 12 is from a support surface, such as a floor.

Also, optionally, personal space protective enclosure 10 can include cap 18 over strip-mounting frame 12, as is shown in FIG. 1. In one embodiment, cap 18 is clear. In another embodiment, not shown, cap 18 defines a perimeter that extends beyond strip-mounting frame 12, and downwardly at the perimeter of cap 18, thereby causing cap 18 to be held in place by strip-mounting frame 12. Cap 18 is fabricated of a suitable material. For example, if clear, cap 18 can be formed of plexiglass or a suitable layered glass and polymer composite.

Figure 10:
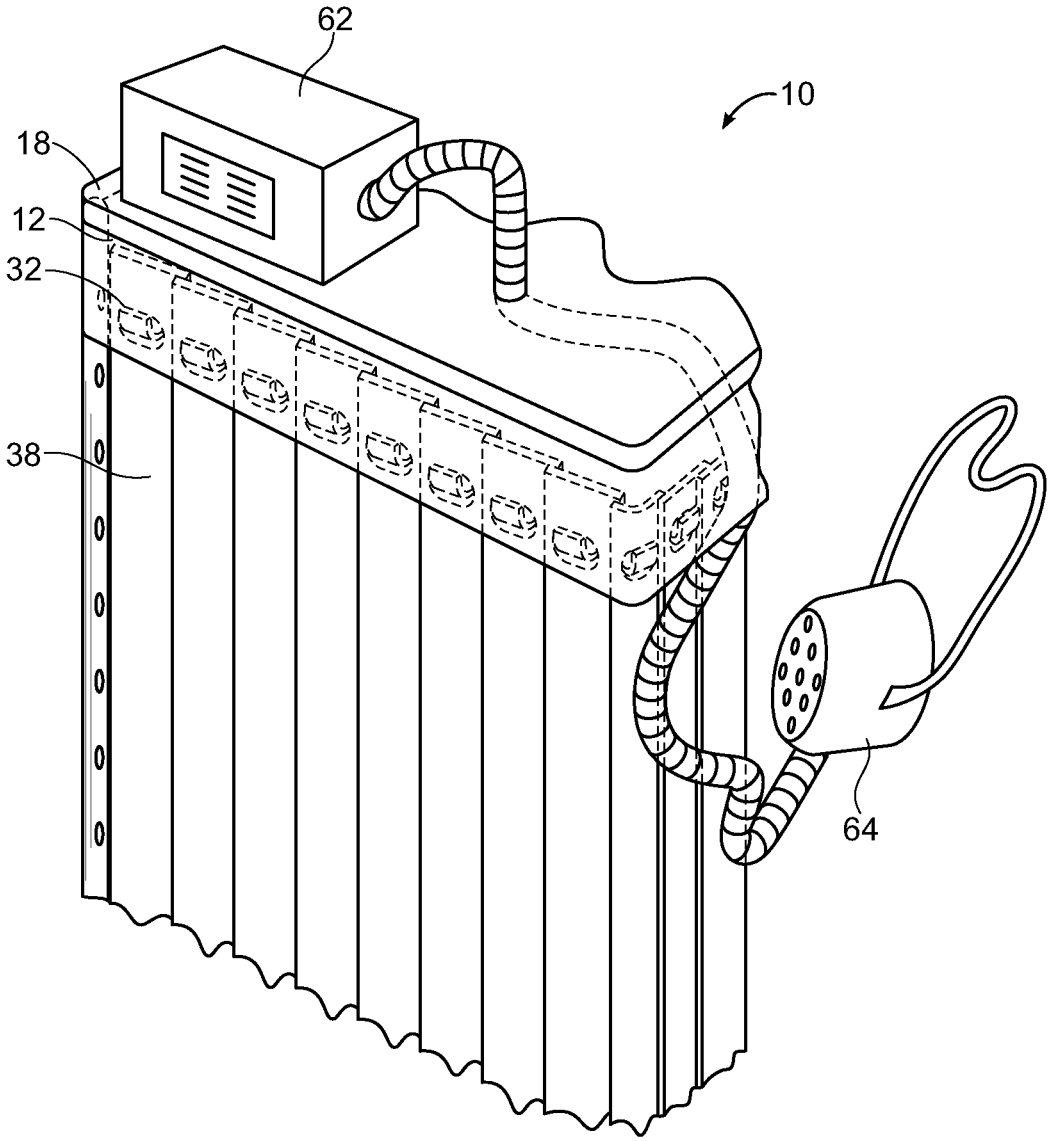
FIG. 10 is a detail of the personal space protective enclosure of FIG. 1, wherein an oxygen-type mask for use by an occupant of the enclosure defined by the vertically-hanging strips is connected to an air-sanitizing unit, that has a fan in it to drive the sanitized air to the user or users inside the protected area of the personal space protective enclosure of the invention.

As another option, personal space protective enclosure 10 includes fan 62, such as a fan that includes a sanitizing filter, at strip-mounting frame 12, as shown in FIGS. 1 and 10. A sanitizing unit with a fan 62 directs air into enclosed space 58 defined by vertically-hanging strips 38, thereby maintaining enclosed space 58 at positive gauge pressure.

In yet another embodiment, personal space protective enclosure 10 further includes at least one oxygen-type mask 64, as is also shown in FIG. 10, whereby occupants of enclosed space 58 can be further protected from airborne pathogens. In one such embodiment, personal space protective enclosure 10 further includes a gas (air or oxygen) supply (not shown) to at least one of enclosed space 58 defined by vertically-hanging strips 38 or, if present, the at least one mask 64.

Figure 11:
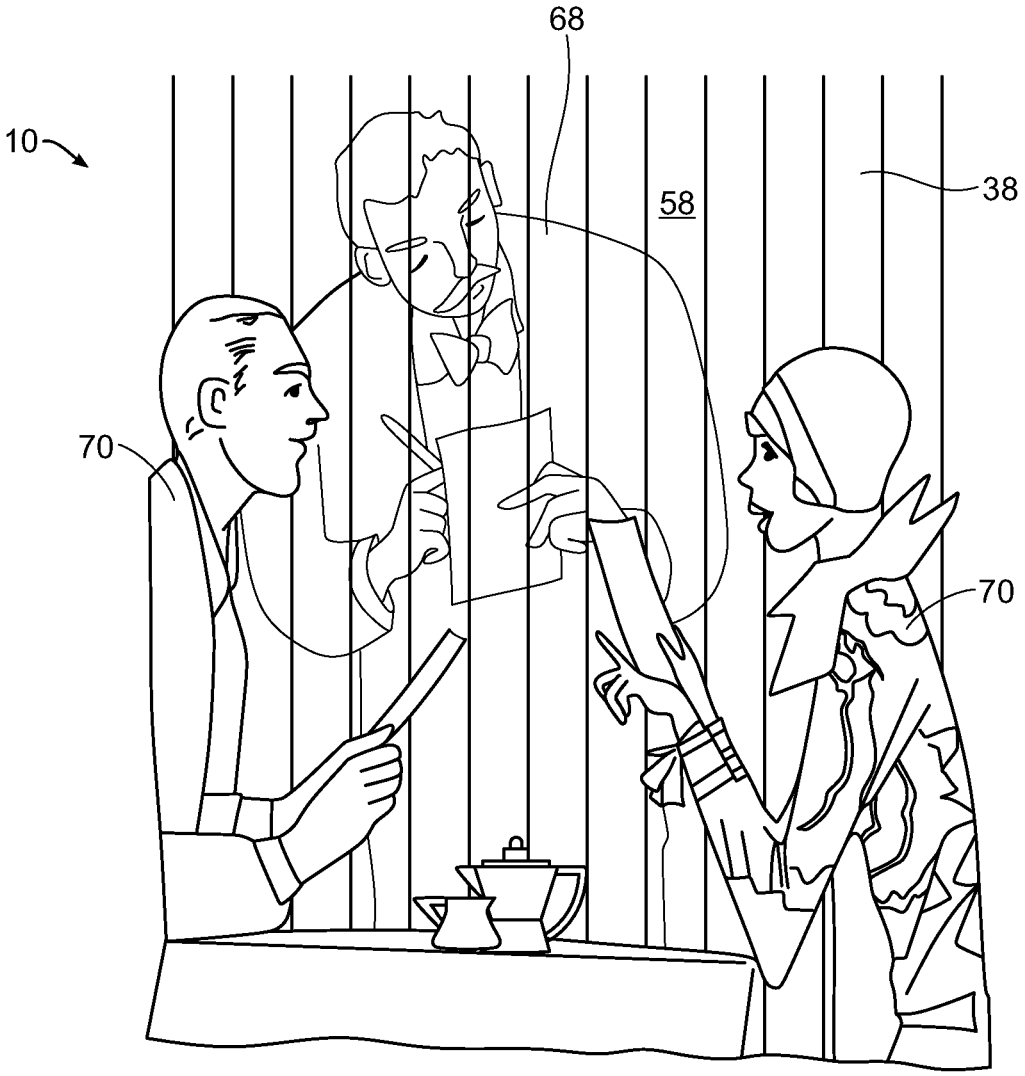
FIG. 11 is a representation of occupants of the personal space protective enclosure of the invention communicating with an individual outside of the personal space protective enclosure, wherein the personal protective space enclosure of the invention is protecting the occupants from airborne pathogens.
Figure 12:
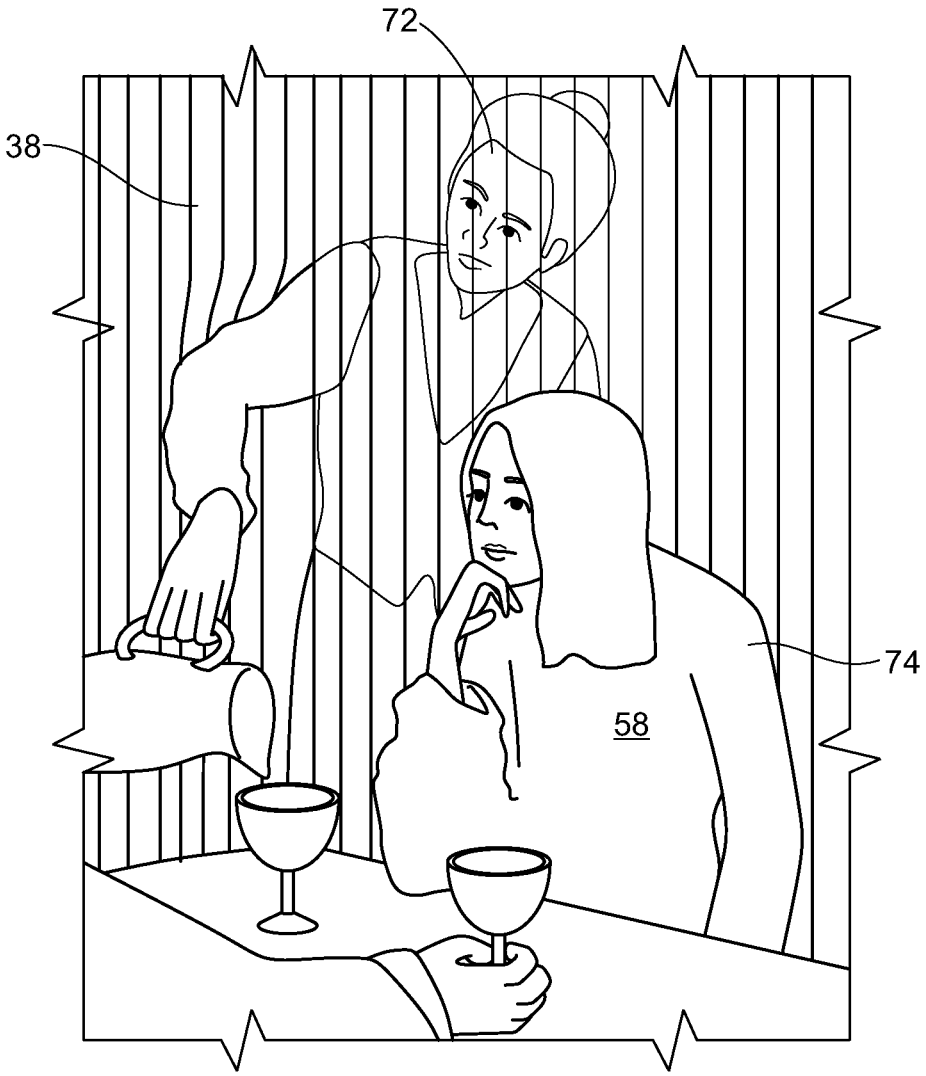
FIG. 12 is a representation of the personal protective space enclosure of FIG. 12, wherein an individual outside of the unit is reaching through the vertically-hanging strips of the enclosure defined by the vertically-hanging strips while the person inside the unit is still protected.
Figure 13:
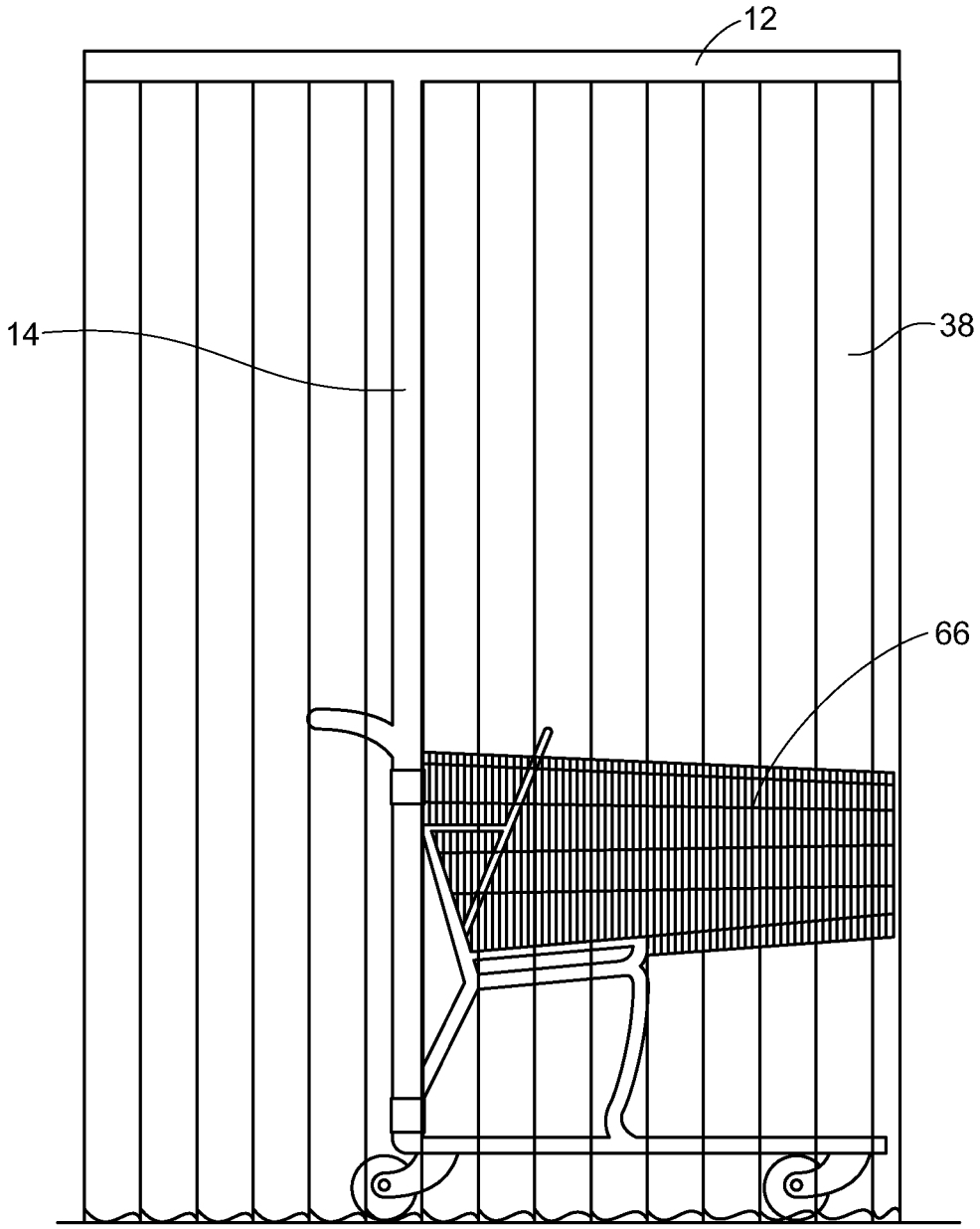
FIG. 13 is a side view of an embodiment of the personal protective space enclosure of the invention that is attached to a shopper cart that is mobile, and enables a protected occupant to reach from within the protective enclosure defined by the vertically-hanging strips.

In use, such as shown in FIG. 11, occupants of the enclosed space 58 defined by vertically-hanging strips 32 are protected from airborne pathogens to which individuals outside enclosed space 58 are exposed, such as wait staff 68 at a restaurant, who nevertheless can communicate and see occupants 70. In addition, individuals outside of enclosed space 58 defined by the vertically-hanging strips 38 can access enclosed space 58 with minimal disruption of protection provided to occupants 74 by the plurality of vertically-hanging strips 38, as can be seen, for example, in FIG. 12. Similarly, in other embodiments, such as mobile shopping cart 66, shown in FIG. 13, a shopper, not shown, can have access to shelved items, not shown, outside the enclosed space defined by vertically-hanging strips 38 by reaching between vertically-hanging strips 38, without significant exposure to airborne pathogens, and without having to wear a mask, or to maintain social distancing, or even be vaccinated like certain people taking cancer treatment cannot be vaccinated.

Definitions

The term "oxygen-enriched air" is used herein to refer to breathable air mixtures that comprise greater than about 21% oxygen ($O_2$) by volume.

While specific embodiments of the subject invention have been discussed, the above specification is illustrative and not restrictive. Many variations of the invention will become apparent to those skilled in the art upon review of this specification and the claims below. The full scope of the invention should be determined by reference to the claims, along with their full scope of equivalents, and the specification, along with such variations.

What is claimed is:

1. A personal space protective enclosure, comprising:

a) a strip-mounting frame, b) at least one support stanchion supporting the strip-mounting frame;

c) a plurality of hooks at the strip-mounting frame, each of which has a rectangular cross-section having a straight upper surface when viewed in one direction and a curvilinear cross-section when viewed in another direction; and d) a plurality of vertically-hanging strips, each of the vertically-hanging strips defining a center of gravity and an opening at one end above the center of gravity, wherein each vertically-hanging strip is separately hung on a single hook of the plurality of hooks at the opening defined by each vertically-hanging strip, the opening of each vertically-hanging strip has a straight upper edge that is contiguous with the straight upper surface of the rectangular cross section of the hook when the vertically-hanging strip is in a resting position, and the vertically-hanging strips being distributed along the strip-mounting frame in partially overlapping relation to each other, whereby each vertically-hanging strip will resume the resting position by force of gravity after having been disturbed, thereby defining an enclosed space.

2. The enclosure of claim 1, wherein the at least one support stanchion supporting the strip-mounting frame includes a plurality of legs.

3. The enclosure of claim 1, wherein the support stanchion is supported by at least one wheel, thereby allowing the personal space protector to be more easily repositionable.

4. The enclosure of claim 1, wherein the support stanchion is affixed to or includes a structure selected from the group consisting of a mobile cart, a desk, or a table.

5. The enclosure of claim 1, wherein at least a portion of the vertically-hanging strips are transparent.

6. The enclosure of claim 1, wherein at least a portion of the plurality of vertically-hanging strips include polyvinylchloride.

7. The enclosure of claim 1, wherein at least a portion of the plurality of vertically-hanging strips are hermetic.

8. The enclosure of claim 1, wherein at least a portion of the plurality of vertically-hanging strips include at least one of a bactericide and a virucide.

9. The enclosure of claim 1, further including a cap over the strip-mounting frame.

10. The enclosure of claim 9, wherein the cap is clear.

11. The enclosure of claim 9, wherein the cap defines a perimeter that extends beyond the strip-mounting frame and extends downwardly at the perimeter of the cap.

12. The enclosure of claim 1, further including an air sanitizing unit with a fan at the strip-mounting frame that directs air into the enclosed space.

13. The enclosure of claim 12, further including a mask that is in fluid communication with the fan, the fan including a filter.

14. The enclosure of claim 1, further including a mask and a supply of air in fluid communication with at least one of the mask and the enclosed space defined by the plurality of vertically-hanging strips.

15. The enclosure of claim 14, wherein the supply of air is selected from the group consisting of air, oxygen-enriched air, and oxygen.

16. The enclosure of claim 15, wherein the supply of air is sanitized.

* * * * *